United States Patent [19]

Elsner et al.

[11] 4,048,804

[45] Sept. 20, 1977

[54] SUPPORT ASSEMBLIES FOR USE IN MINE WORKINGS

[75] Inventors: Burckhardt Elsner; Lubomir Plevak; Günter Lagodka, all of Lunen; Harry Rosenberg, Ludinghausen, all of Germany

[73] Assignee: Gewerkschaft Eisenhutte Westfalia, Lunen, Germany

[21] Appl. No.: 721,636

[22] Filed: Sept. 8, 1976

[30] Foreign Application Priority Data

Sept. 9, 1975 Germany ..... 2540091

[51] Int. Cl.[2] ..... E21D 15/44

[52] U.S. Cl. ..... 61/45 D

[58] Field of Search ..... 61/45 D; 299/31, 33; 248/357; 97/170 MP

[56] References Cited

U.S. PATENT DOCUMENTS

| | | | |
|---|---|---|---|
| 3,106,825 | 10/1963 | Barall et al. | 61/45 D |
| 3,915,500 | 10/1975 | Schlusener et al. | 61/45 D X |
| 3,928,981 | 12/1975 | Parker et al. | 61/45 D |
| 3,959,976 | 6/1976 | Blumenthal | 61/45 D |

FOREIGN PATENT DOCUMENTS

| | | | |
|---|---|---|---|
| 2,213,793 | 9/1973 | Germany | 61/45 D |
| 2,164,365 | 6/1973 | Germany | 61/45 D |

*Primary Examiner*—Dennis L. Taylor

*Attorney, Agent, or Firm*—Sughrue, Rothwell, Mion, Zinn and Macpeak

[57] ABSTRACT

A mine support assembly is composed of separate floor-engaging sills each supporting one or more telescopic props and a goaf shield pivotably connected to a roof cap. The props can be extended or retracted to raise or lower the roof cap. The shield is divided into a common upper section and lower parts each pivotably connected to the upper section and to a respective associated one of the floor sills. Levers are pivotably connected between the sills and the upper section of the goaf shield and serve with the lower shield parts as a guide means ensuring the roof cap is raised or lowered without appreciable horizontal displacement. The floor sills and lower shield parts are respectively spaced apart and a shifting ram is connected to the floor sills via a transverse yoke pivotably connected to the forward end regions of the sills. The ram is located in a space between the sills and is connected at its rear end to a cross piece guided in the sills and connected to bars which extend along the space between the sills to form a cantilever beam connected directly or indirectly to a longwall conveyor.

12 Claims, 5 Drawing Figures

FIG.4
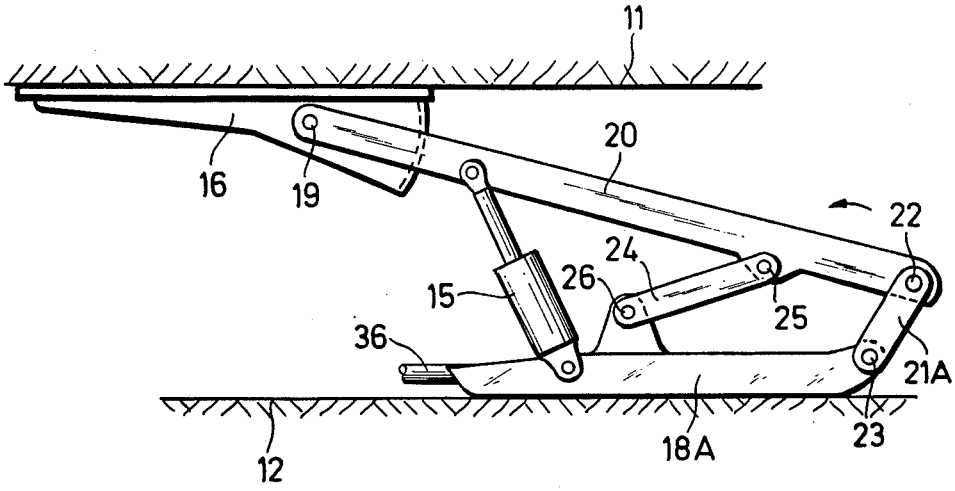
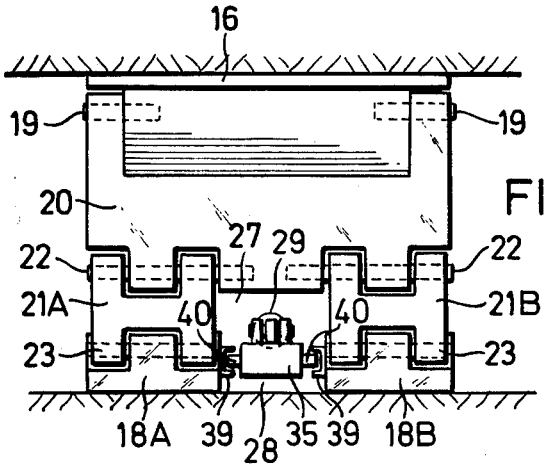
FIG.5

SUPPORT ASSEMBLIES FOR USE IN MINE WORKINGS

BACKGROUND OF THE INVENTION

The present invention relates to support assemblies for use in mine workings.

In the mining art it is well known to employ support assemblies with hydraulic telescopic props carried on floor-engaging means and capable of being braced between the floor and roof of a mine working. A common roof cap can be mounted at the upper ends of the props. A series of such assemblies would normally be arranged alongside a scraper-chain conveyor and shifting rams would then connect the assemblies to the conveyor to enable each assembly and an associated portion of the conveyor to be moved up alternately to follow the mining progress.

It is also known to provide a goaf shield at the goaf side of the assembly to screen off the assembly from the goaf or stowage zone. The goaf shield is arranged to displace as the props extend or retract and it is generally desirable to provide a so-called lemniscate guide system which maintains the orientation and horizontal position of the roof cap so that the roof cap moves in a vertical sense with no significant longitudinal displacement when the props are operated. In this way the forward end of the cap nearest the mineral face moves in a vertical line. An example of such an assembly is described in German patent specification 2217830.

The known forms of support assembly suffer from a number of disadvantages. In order to prevent deformation forces from acting on the guide system and goaf shield the one piece floor-engaging means is usually a rigid heavy torsion-resistant structure which is costly to manufacture. Moreover the one-piece floor structure is not always able to cope with irregularities in the level of the floor. The goaf shield is usually designed to completely screen off the working zone from the goaf or stowage zone and any accumulation of debris or other material in the support region can cause problems during shifting of the support assembly.

A general object of the present invention is to provide an improved support assembly for a mine working.

SUMMARY OF THE INVENTION

According to the invention there is provided a support assembly for use in a mine working; said assembly having separate floor sills each carrying one or more extendible props, a common upper goaf shield, plural linkage means each pivotably connected to a respective one of the sills and to the upper goaf shield and lower goaf shield parts each pivotally connected to a respective one of the sills and to the upper goaf shield, the linkage means and lower goaf shield parts permitting relative positional adjustment between the floor sills.

The invention also provides a support assembly for use in a mine working; said assembly comprising extendible hydraulic props supported on floor-engaging means, a roof cap which can be braced against the roof of a mine working when the props are extended, a goaf shield pivotably connected to the roof cap, the goaf shield having upper and lower sections and guide means for maintaining the same orientation and position for the roof cap so that the latter moves in a vertical path when the props are extended or retracted wherein: the floor-engaging means comprises a plurality of vertically-displaceable separate parts each supporting at least one of the props, the lower section of the goaf shield comprises a similar plurality of parts each pivotably connected to the upper goaf screen section and to a respective one of the floor-engaging parts and the guide means at least includes linkages each pivotably connected to a respective one of the floor-engaging parts and to the upper goaf screen section.

The provision of the separate floor sills or parts each linked in an articulated manner to the main upper shield with a guide linkage and with a lower shield section or part provides enhanced adaptability to any irregularities in the floor of the working and deformation forces are inhibited from acting on the shield or guide means.

Generally each floor sill or part can pivot about their associated linkage and the sills or parts can displace in a vertical manner in relation to one another.

The props may directly support a common roof cap pivoted to the upper shield or else the props may be mounted at their upper ends to the upper shield which then supports a roof cap.

It is preferable to space the lower shield parts apart to form an opening therebetween in the order of half the transverse width of these shield parts. This creates a pathway to enable the escape of any material accumulating on the floor-engaging parts when the assembly is shifted up. A shifting ram provided for this purpose may be conveniently positioned in a space formed between the floor sills or parts. The floor sills or parts are also preferably interconnected at their forward regions remote from the goaf shield and nearest the mineral face with the aid of a transverse yoke pivoted to the sills or parts. This yoke then maintains the spacing between the floor sills or parts but allows the relative vertical displacement between the sills or parts. The shifting ram can then be connected to this yoke and the rear end of the ram can be connected to a single or multi-part cantilever beam connected or connectible to a conveyor. The ram can thus bear on the floor sills or parts via the yoke when the conveyor is to be displaced. The cantilever beam can be in the form of two rods extending on opposite sides of the ram and interconnected at their ends nearest the goaf shield with a cross-piece guided on or in the floor sills or parts. The beam and its associated guides thus serve to guide the assembly when the ram is operated to move the latter up to the conveyor.

The invention may be understood more readily and various other features of the invention may become more apparent from consideration of the following description.

BRIEF DESCRIPTION OF DRAWINGS

Embodiments of the invention will now be described, by way of examples only, with reference to the accompanying drawings, wherein:

FIG. 4 is a schematic side view of another support assembly made in accordance with the invention; and FIG. 5 is an end view taken from the goaf zone of the assembly shown in FIGS. 1 and 2.

DESCRIPTION OF PREFERRED EMBODIMENTS

Figure 1:
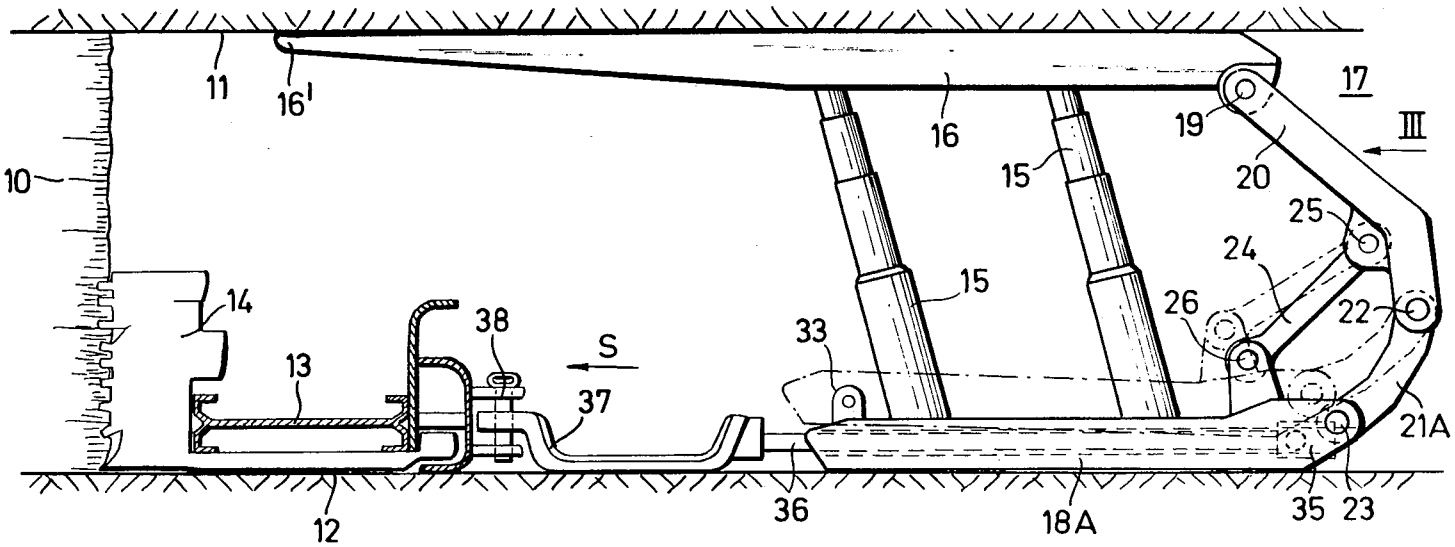
FIG. 1 is a schematic side view of a mining installation employing a support assembly made in accordance with the invention.

As shown in FIG. 1, a longwall mine working has a mineral, e.g. coal, face 10 and a floor 12. A mine installation in this working utilizes a longwall scraper-chain conveyor 13 arranged alongside the face 10 and a winning machine, such as a plough 14 is guided on the conveyor 13 for movement back and forth along the face 10 to detach material therefrom.

Figure 2:
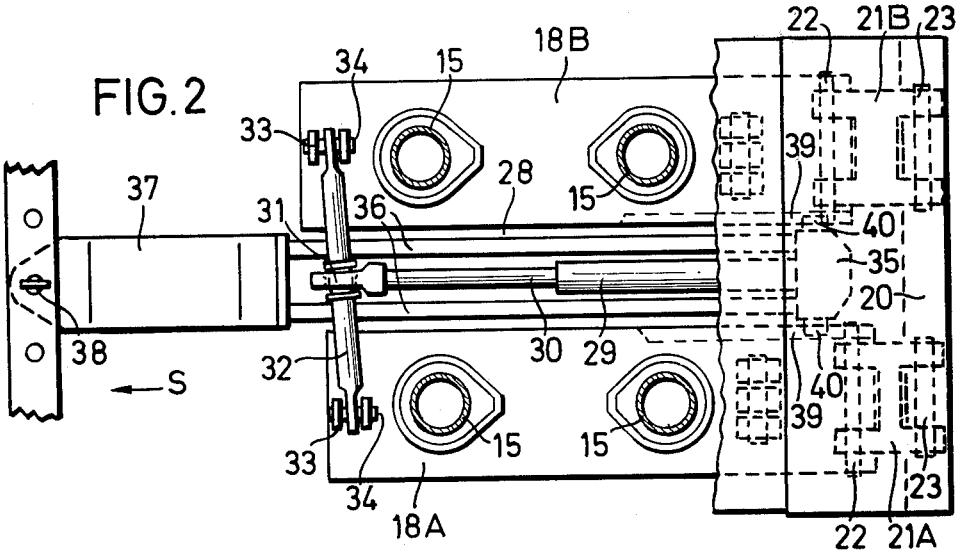
FIG. 2 is a plan view of part of the support assembly shown in FIG. 1.
Figure 3:
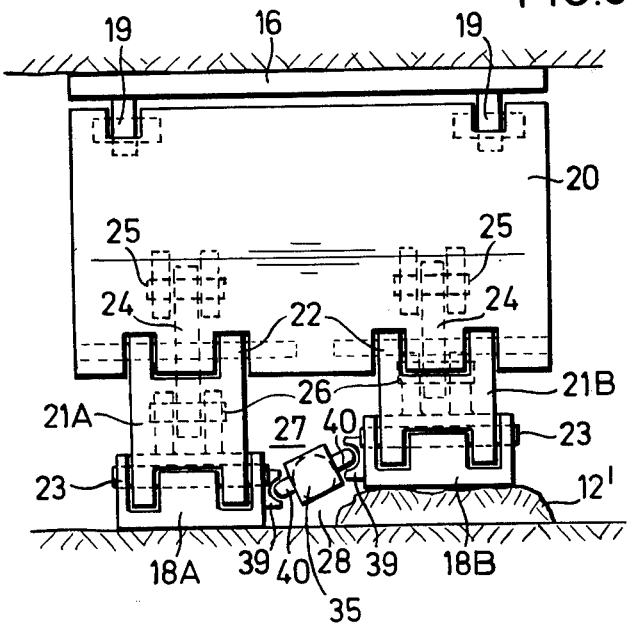
FIG. 3 is an end view, taken from the goaf zone, of the support assembly shown in FIGS. 1 and 2.

In this case the plough 14 has a sword plate extending beneath the conveyor and guided by guide means on the side of the conveyor 13 remote from the face 10. Referring now to FIGS. 1 to 3, one or more support assemblies constructed in accordance with the invention are located at the side of the conveyor 13 remote from the face 10. The assembly comprises four hydraulically-operated telescopic props 15 in rectangular array (FIG. 2) connected between floor and roof engaging means. More particularly, the props 15 are connected at their upper ends with ball-and-socket joints to a common one-piece roof cap 16 which engages on the roof over an area which commences close to the working face 10 and which terminates in the goaf zone 17. The props are supported at their lower ends by skid-like floor sills 18A, 18B and again ball-and-socket joints are preferably incorporated between the feet of the props 15 and the sills 18A, 18B.

An upper, main, common goaf shield 20, which is of one-piece construction and has a width substantially the same as the roof cap 16, serves in known manner to screen-off the assembly from the goaf zone 17. The shield 20 is connected to the roof cap 16 at the rear end of the latter by means of pivot joints 19. Lower goaf shield parts 21A, 21B are pivotably connected between the upper shield 20 and the floor sills 18A, 18B, respectively. The pivot joints between the sills 18A, 18B and the shield parts 21A, 21B are designated 23 and the pivot joints between the shield 20 are designated 22. Levers 24 each forming a linkage means are connected with pivot joints 25 to the shield 20 and with pivot joints 26 to brackets or the like on the sills 18A, 18B. The pivot axes of the joints 19, 22, 23, 25, 26 are all parallel to one another and extend transversally to the shifting direction S. With the construction as described, each floor sill 18A, 18B is provided with its own guide system 24, 21A, 24, 21B which is designed to form the known lemniscate guide between the shield 20 and the roof and floor-engaging components. This guide ensures that the shield 20 maintains reliable screening off of the installation from the goaf zone 17 whether the props 14 are retracted or extended and the cap 16 carries out no appreciable longitudinal movement when the props 15 are extended or retracted so that the forward end 16' of the cap 16 maintains the same position moving in a vertical plane as the props 15 extend or retract.

The division of the floor-engaging means of the assembly into the separate parts 18A, 18B and the provision of the associated separate shield parts 21A, 21B enables the assembly to readily adapt to irregularities in the level of the floor 12 of the working. Thus, by way of illustration, FIG. 3 shows a high spot 12' in the floor 12 which lies beneath the sill 18B. Consequently, the sill 12B is raised in relation to the sill 12A and slides at this higher level during shifting of the assembly. The raised position of the sill 12B and of its lever 24 is represented in FIG. 1 in chain-dotted lines. In general, the sills 12A, 12B can perform largely independent articulated movements about the axes of the joints 22, 23 while maintaining an essentially parallel relationship. As the sills 12A, 12B adjust themselves about the axes of the joints 22 this is accompanied by a slight longitudinal relative movement between the sills 12A, 12B. Any adjustment of the sills 12A, 12B to cope with floor irregularities is accomplished without introducing unduly high forces in any of the assembly components.

As can be seen in FIG. 3, the shield parts 21A, 21B are spaced apart forming an opening 27 therebetween and any material which collects on and beside the sills 12A, 12B can easily pass through the opening 27 into the goaf zone 17 as the assembly is shifted up in the direction of the arrow S by means of a hydraulic shifting ram 29.

The sills 18A, 18B are similarly spaced apart in the transverse sense and the shifting ram 29 is accommodated in the space 28 between the sills 18A, 18B. The ram 29 has a piston rod 30 connected by a pivot bearing 31 to a transverse yoke 32 (FIG. 2) flexibly interconnecting the forward regions of the sills 18A, 18B. The yoke 32 is pivotably connected to brackets 33 on the sills 18A, 18B with the aid of pivot joints 34 designed to accommodate the aforementioned adjustability of the sills 18A, 18B in relation to the floor 12. Although the yoke 32 does not hinder the relative vertical movements between the sills 18A, 18B the yoke 32 maintains the spacing between the sills 18A, 18B. At its rear end, the ram 29 has its cylinder mounted to a cross-piece 35 which connects with a cantilever beam here composed of two rods 36. The rods 36 extend on opposite sides of the ram 29 and are also located in the space 28. The rods 36 are interconnected with the cross-piece 35 on their rear ends. At their forward ends, the rods 36 are interconnected through an intermediate linkage here constructed as a channel or trough component 37. The component 37 is in turn pivoted about a vertical axis to the goaf side of the conveyor 13 by means of a pivot joint 38. The rods 36 are guided in guides 39 formed on the sills 18A, 18B. These guides 39 can be U-shaped channel sections and the cross-piece 35 has spigots 40 which engage in these guides 39 in sliding and pivotal manner. This system again does not hinder the adjustability of the sills 18A, 18B. As can be appreciated when the ram 29 is retracted and the props 15 are braced between the roof and floor the conveyor 13 is shifted up in the direction of the arrow S with the shifting forces being transmitted through the rods 36. Conversely, with the props 15 relieved, the ram 29 can be extended to draw up the entire assembly in the direction of the arrow S.

The cantilever beam, composed in the illustrated embodiment of the rods 36, serves to guide the assembly during shifting only but it is possible to adapt this beam to tilt the conveyor 13 and hence the machine guidance to adjust the cutting provile of the machine 14.

The assembly depicted in FIGS. 4 and 5, is essentially of the same design as that depicted in FIGS. 1 to 3. Consequently like reference numerals are used to denote like and analogous parts and no detailed explanation of the assembly shown in FIGS. 4 and 5 is felt to be necessary. The main difference between the assembly of FIGS. 1 to 3, and the assembly of FIGS. 4 and 5 is that in the latter case only one prop 15 is provided on each floor sill 18A, 18B and this prop 15 is not connected at its head to the cap 16 but rather to the main shield 20. Ball and socket, or as illustrated pivot joints, are provided to link the props 15 to the sills 18A, 18B and to the shield 20.

We claim:

1. A support assembly for use in a mine working; said assembly comprising: separate floor-engaging sills, at least one extendible prop carried by each of said sills, a common upper goaf shield, a roof cap, means pivotably connecting the upper goaf shield to the roof cap, the props being operable to raise and lower the roof cap and the upper goaf shield, plural linkage means each pivotably interconnecting the upper goaf shield to a respective one of the floor sills, lower goaf shield parts, means pivotably connecting the lower goaf shield parts to the upper shield and means pivotably connecting each of the lower goaf shield parts to a respective one of the floor sills whereby the floor sills can move relative to one another to adjust to irregularities in the floor of a mine working.

2. An assembly according to claim 1, wherein the lowe goaf shield parts are spaced apart to form an opening therebetween.

3. An assembly according to claim 1, wherein the floor sills are spaced apart transversally of the assembly and a shifting ram is located within the space between the floor sills.

4. An assembly according to claim 1, wherein the floor sills are interconnected to their forward end regions remote from the goaf shield by means of a transverse yoke pivotably connected to the floor sills.

5. An assembly according to claim 4, wherein the floor sills are interconnected at their forward end regions remote from the goaf shield by means of a transverse yoke pivotably connected to the floor sills, and wherein the shifting ram is connected to the yoke and to a cantilever beam.

6. An assembly according to claim 5, wherein means is provided for connecting the cantilever beam to a conveyor.

7. An assembly according to claim 5, wherein the cantilever beam is composed of two rods extending on opposite sides of the shifting ram and wherein the rods are interconnected at their ends nearest the goaf shield with a cross-piece guided in relation to the floor sills.

8. An assembly according to claim 1, wherein the props directly support the roof cap.

9. An assembly according to claim 1, wherein the props are connected at their ends to the upper goaf shield.

10. An assembly according to claim 1, wherein all the pivot axes extend parallel to one another.

11. A support assembly for use in a mine working; said assembly comprising extendible hydraulic props supported on floor-engaging means, a roof cap which can be braced against the roof of a mine working when the props are extended, a goaf shield pivotably connected to the roof cap, the goaf shield having upper and lower sections and guide means for maintaining the same orientation and position for the roof cap so that the latter moves in a vertical path when the props are extended or retracted wherein: the floor-engaging means comprises a plurality of vertically-displaceable separate parts each supporting at least one of the props, the lower section of the goaf shield comprises a similar plurality of parts each pivotably connected to the upper goaf screen section and to a respective one of the floor-engaging parts and the guide means at least includes linkages each pivotably connected to a respective one of the floor-engaging parts and to the upper goaf screen section.

12. In a shield-type mine roof support assembly which has a goaf shield pivoted to a roof cap and a plurality of telescopic props carried on floor-engaging means and operable to brace the roof cap against the roof of a mine working; the improvements comprising:

constructing the floor-engaging means from separate parts, constructing the goaf shield as an upper common main section which is pivotably connected to separate lower shield parts, connecting each floor-engaging part to the upper section of the shield by way of a pivotable lever designed to maintain a horizontal disposition for the roof cap when the props are raised or lowered and pivotably interconnecting each lower shield part to a respective one of the floor-engaging parts to thereby allow relative displacement between the floor-engaging parts in a vertical sense.

* * * * *